United States Patent [19]

Takenaka

[11] Patent Number: 4,627,393

[45] Date of Patent: Dec. 9, 1986

[54] IGNITION DISTRIBUTOR

[75] Inventor: Akihiko Takenaka, Kariya, Japan

[73] Assignee: Nippondenso Co., Ltd., Kariya, Japan

[21] Appl. No.: 746,791

[22] Filed: Jun. 20, 1985

[30] Foreign Application Priority Data

Jun. 28, 1984 [JP] Japan ..... 59-134782

[51] Int. Cl.[4] ..... F02P 7/02

[52] U.S. Cl. ..... 123/146.5 A; 200/19 R

[58] Field of Search ..... 123/146.5 R, 146.5 A; 200/19 R, 19 DC, 19 DR

[56] References Cited

U.S. PATENT DOCUMENTS

| | | | |
|---|---|---|---|
| 2,207,368 | 7/1940 | Arthur | 200/19 R X |
| 2,415,510 | 2/1947 | Mallory | 200/19 R |
| 4,281,627 | 8/1981 | Sakurai | 123/146.5 A |
| 4,343,269 | 8/1982 | Fox et al. | 123/146.5 A |
| 4,545,340 | 10/1985 | Schreiner | 123/146.5 A |

FOREIGN PATENT DOCUMENTS 0093836 7/1977 Japan .

*Primary Examiner*—Willis R. Wolfe, Jr.

*Attorney, Agent, or Firm*—Cushman, Darby & Cushman

[57] ABSTRACT

An ignition distributor for internal combustion engines that improves ventilation efficiency, particularly when a rotor electrode does not come close to counterelectrodes, and that protects against the effect of an unfavorable thing to the outside of the distributor, which triggered by the discharge action. A closure member is provided that is mounted on to the distributor shaft and is in position adjacent to the inboard openings of ventilating holes formed in the housing which communicate the inside of the housing with its outside for ventilation. The member controls the communication therebetween for substantially restricting the communication when the discharge occurs in the housing and opening it when the discharge does not occur. The opening and closing of the communication is alternately repeated in response to the exact ignition discharge timing.

6 Claims, 8 Drawing Figures

IGNITION DISTRIBUTOR

FIELD OF THE INVENTION

The present invention relates to improvements in an ignition distributor of an automotive vehicle delivering a high voltage from the coil to the proper spark plug in the firing order.

DESCRIPTION OF THE PRIOR ART

An ignition distributor of a vehicle generally has a plate secured to a housing of the distributor, through which the ignition apparatus is secured to the engine by means of screws or the like. By the way, such distributor generally has through-holes formed in the housing for ventilation through which fresh air is introduced into the inside of the housing and air containing ozone, nitrogen oxide or the like generated by the discharge therein is discharged outside the distributor housing therethrough in order to protect parts housed in the distributor against corrosion damage. However, if gassorine vapour which is inflammable enters the housing through the above-mentioned through-holes and catches fire by the discharge therein, such spark comes out of the housing through the holes.

To prevent such problem, much improvements have been done, but very few of them have been put into practical use costwise. One of good counter-measures for solving the problem was disclosed, for example, in a Japanese laid-open unexamined utility model application No. 52-93836 which comprises a plate secured to a body of a distributor, through which the ignition apparatus is secured to the engine by means of screws. The disclosed distributor further has a bore having its length in the axial direction in the body, one end of which opens into the housing room and the other end to the outside of the housing, wherein the other end opening portion and the above described plate are facing each other to form an air gap therebetween so that an unfavorable thing happened within the housing, which has been caused by the discharge, is prevented from coming outside of the housing through such bores.

However, the above described conventional type distributor in turn has a difficiency that because of the other side opening, adjacent to the plate all the time with narrow air gap therebetween, this may degrade the ventilation effect thereof.

SUMMARY OF THE INVENTION

Accordingly, in order to throughly solve the problems of the prior art, as described herein, an object of the present invention is to provide certain improvements in the construction of and the ventilation effect of the ignition distributor which is adapted to be easily manufactured to suppress or substantially eliminate unwelcome influence to parts mounted near the distributor through the ventilation holes, which is caused by the discharge, as well as to provide good ventilation effects within the housing.

This object is accomplished by having a plurality of through-holes provided in the housing, each of which communicates the outside of the housing with its inside, and by also having a member mounted onto a rotary shaft disposed within the housing and they are arranged so that such through-holes are substantially closed with the member when a discharge electrode and each side electrode are facing each other by rotation of the shaft driven from the engine camshaft. There be made communication passages between the outside of the housing and its inside when the discharge electrode and each side electrode are not facing each other. Therefore, even when any unfavorable thing happened within the housing, which has caused by the discharge, it can be prevented from reaching outside the housing through the holes when the discharge electrode comes close to each side electrode, on the other hand, good ventilation effects between the outside of the housing and its inside are gained via the holes during a time that the discharge does not occur.

BRIEF DESCRIPTION OF THE DRAWINGS

The above and other objects, features and advantages of the present invention will be apparent from the following description of the preferred embodiments when considered in conjunction with the accompanying drawings.

DESCRIPTION OF THE PREFERRED EMBODIMENT

Figure 1:
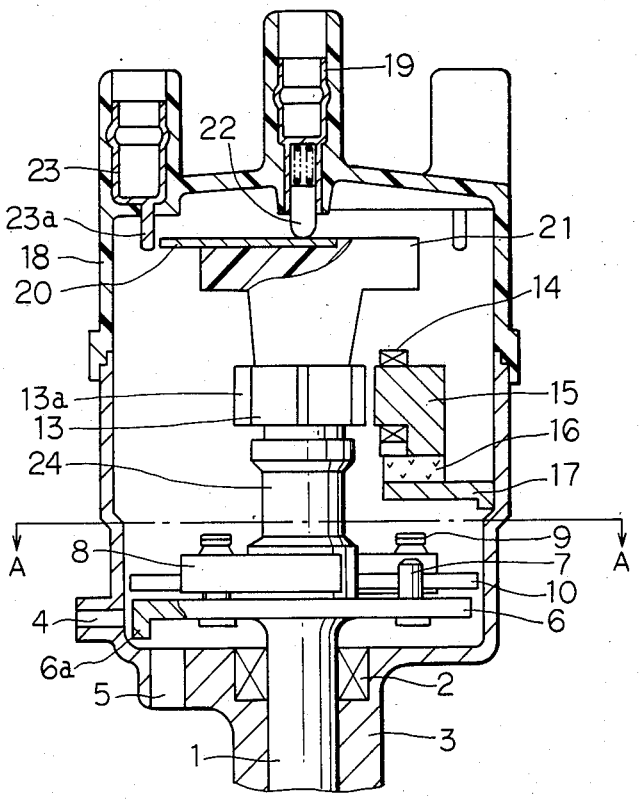
FIG. 1 is a sectional view of a first embodiment of an ignition distributor according to the present invention.
Figure 2:
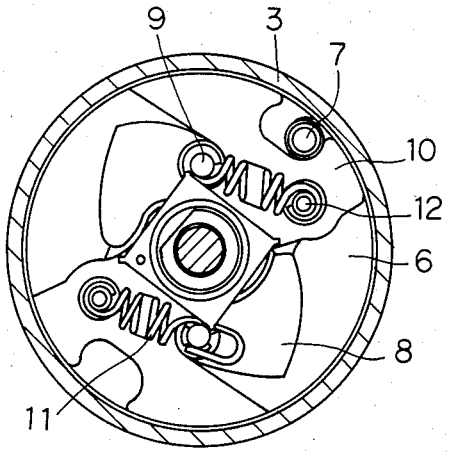
FIG. 2 is a plan view taken on line A—A of FIG. 1.
Figure 3:
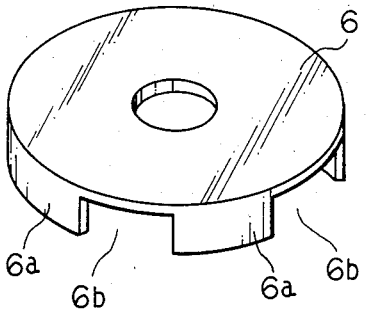
FIG. 3 is a perspective view of a governer plate of the first embodiment.

Referring now to FIGS. 1 to 3, 3 designates a distributor housing having a bearing 2 which supports for rotation an engine driven shaft 1. First and second through-holes 4 and 5 are provided at the side of and the bottom of the housing 3 respectively. 6 designates a disc type governer plate mounted onto the shaft 1, which includes a pin 7. Flyweights 8 having pins 9 are rotatably supported to the governer plate 6. A governer advance adjusting mechanism consists of the governer plate 6, the pin 7, the fly-weights 8, the pin 9, cam plates 10, springs 11 and pins 12. The flyweights 8 and the cam plates 10 are retained by the springs 11. A signal rotor 13 is secured to a tube member 24 drivingly connected with the shaft 1 by the governer advance adjusting mechanism capable of changing the angular relation between the shaft 1 and the signal rotor 13. A bracket 15 including coil windings 14 is disposed in position shown in FIG. 1 so that it faces the signal rotor 13 and is supported within the housing 3 by a magnet 16 and a supporting member 17. A distributor cap 18 is held upon the housing 3 by appropriate means such as a clamp spring or the like. 19 designates a center electrode to which coil secondary high voltage output is fed and which is electrically connected with a spark gap electrode 20 by a spring 22 supported by the housing 3. The spark gap electrode 20 is fixed and secured to a body or rotor 21 supported by the tube member 24 drivingly connected with the shaft 1. Distributor cap electrodes or side electrodes 23 are provided in the distributor cap 18 and are disposed such that they, four side electrodes 23 in the embodiment, are spaced equally round the periphery of the cap 18 and their extended tip portions 23*a* come close to the spark gap electrode 20 as the rotor 21 turns. The governer plate 6, as shown in FIG. 3, includes four axial integral flanges 6*a* equally spaced on its circumference, which face the inside wall of the housing 3 to form a narrow air gap therebetween. As shown in FIG. 1, the first through-hole 4 is substantially closed with one of the flanges 6*a* when the spark gap electrode 20 becomes close to each extended tip portion 23*a* of the side electrodes 23, therefore, the flanges 6*a* have, in the longitudinal direction, length longer enough to cover the opening portion of the first through-hole 4 during a time that the spark gap electrode 20 and the side electrodes 23 are facing each other while the second through-hole 5 being substantially covered with the bottom side surfaces of the governer plate 6.

In operation, the shaft 1 rotates as the engine speed increases. As the distributor shaft 1 rotates faster, the flyweights 8 swing outward against spring pressure of the springs 11 while advancing or moving the cam plates 10 forward in the direction of rotation in relation to the distributor shaft position. At this time, the tube member 24 is also advanced in time in the rotational direction. An electrical signal generated for every passing of projections 13*a* of the signal rotor 13 across the bracket 15 functions as accurately breaking or interrupting the coil primary current flowing through a primary winding of an ignition coil. And, the secondary high voltage output in response to an ignition timing being generated, it is fed to the center electrode 19 and flows through the center electrode 19 to the spark plugs in the correct order to match the engine firing order, via the spring 22, the spark gap electrode 20 and the side electrodes 23.

When the spark gap electrode 20 comes close to the side electrodes 23 the discharge occurs. Even if any unfavorable thing accidentally happened within the distributor housing 3, which has been caused by the discharge, at this time, the first and second through-holes 4 and 5 are substantially covered by the proper flange 6*a* of and the bottom side surfaces of the governer plate 6 respectively whereby such unfavorable thing can be prevented from reaching outside the distributor through the through-holes 4 and 5.

On the other hand, when the spark gap electrode 20 and the side electrodes 23 are not facing each other, the flange 6 is positioned to make air passages for ventilation between the first and second holes 4 and 5 through cut portions 6*b*. Rotational motion of the governer plate 6 and the cam plate 10 causes air to flow into and out of the distributor through the holes 4 and 5, the ventilation effects are, thus, much more improved and as the flange portions 6*a* for intermittently shuttering the air passages with respect to the discharge timing are formed into an integrated body with the existing governer plate whereby there is no necessary to provide additional parts for such purposes, then, the number of parts can be reduced.

Figure 4:
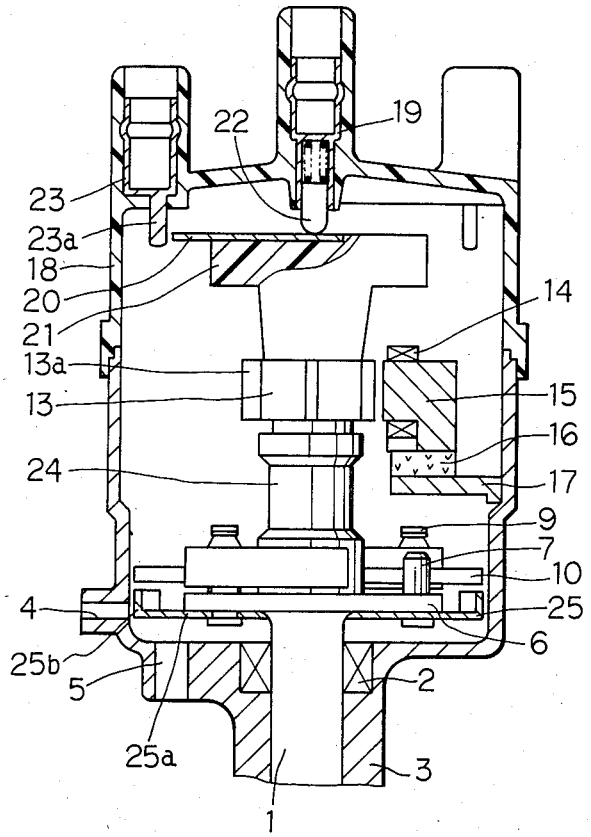
FIG. 4 is a sectional view of a second embodiment.
Figure 5:
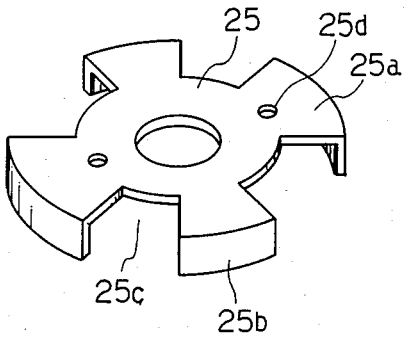
FIG. 5 is a perspective view of the plate of the second embodiment.
Figure 6:
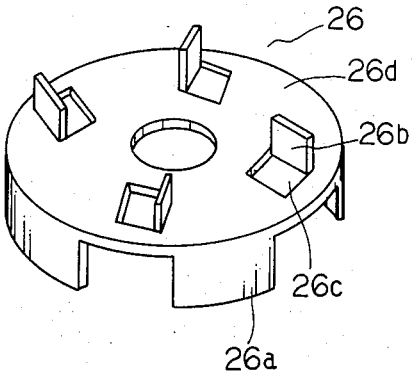
FIG. 6 is other embodiment of the plate used in the second embodiment.

In the above-described first embodiment, the governer plate 6 has a double function. However, as shown in FIGS. 4 and 6, a second embodiment, a plate 25 having integral general axial tongues 25*b* is secured to the governer plate 6 by the pins 9 pressed into holes 25*d* in the plate 25 and secured by means of crimping or the like. The plate 25, hereupon, has flat surface portions 25*a* and the tongues 25*b* as shown in FIG. 5 so that when the spark gap electrode 20 comes close to the side electrodes 23, at this time, too, the first and second through-holes 4 and 5 are substantially closed by the proper tongue 25*b* of-and the flat surfaces 25*a* of the plate 25 both adjacent to the inboard openings of the through-holes 4 and 5 respectively, whereby, as in the same manner shown in the first embodiment described above, any unfavorable thing accidentally happened in the distributor housing 3, which triggered by the discharge action, can be prevented from reaching outside the distributor housing 3. On the other hand, when the spark gap electrode 20 and the side electrodes 23 are not facing each other, or when the discharge does not occur, the plate 25 is positioned to make for ventilation air passages between the both through-holes 4 and 5 through cut portions 25*c*, then, a sufficient air goes in and out of the distributor housing 3.

In stead of using the plate 25, a cup-like stamping 26 of FIG. 6 can substitute in this second embodiment, in which substantially rectangular tabs 26*b* are stamped from a body portion 26*d*, projecting outwardly from the body portion 26*d* at position shown in FIG. 6, to function as fan blades when the stamping 26 is driven in rotation by means of the shaft 1, a sufficient amount of air flows from the second through-hole 5 to the first through-hole 4 through slots 26*c* and spaces between flanges 26*a*. Accordingly, when the spark gap electrode 20 comes close to each of the extended tip portions 23*a* of the side electrodes 23, as in the same manner described heretofore, an unfavorable thing accidentally happened in the distributor housing 3, which triggered by the discharge action, can be prevented by the flange portions 26*a* from reaching outside of the distributor via the through-holes 4 and 5.

Figure 7:
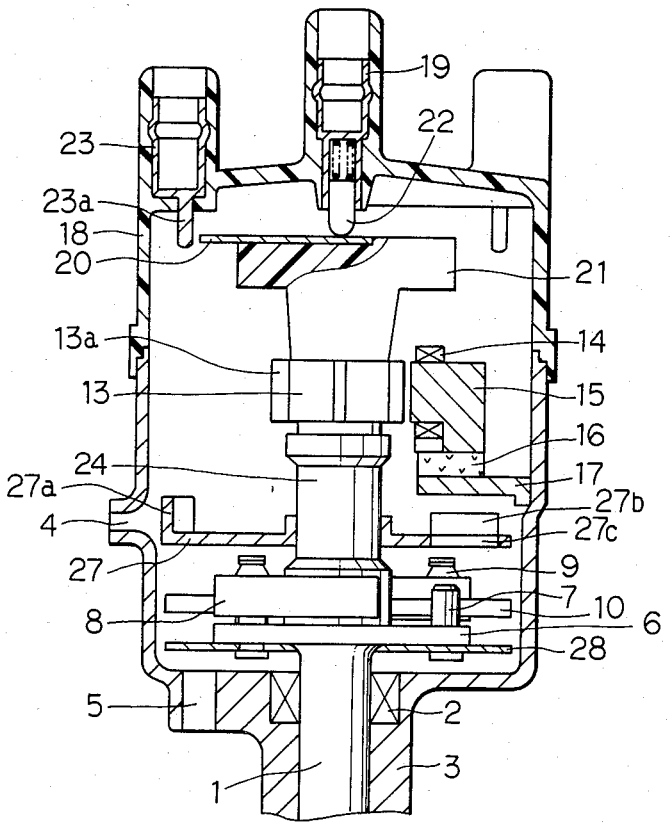
FIG. 7 is a sectional view of a third embodiment.
Figure 8:
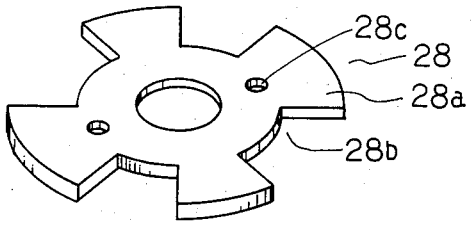
FIG. 8 is a perspective view of a plate used, with the third embodiment of the invention, in association with another plate which is slightly modified from FIG. 6.

In the above-described first and second embodiments, the first through-hole 4 is provided at a relatively lower side portion of the housing 3, but, in a third embodiment shown hereupon, the first through-hole 4 is provided at position shown in FIG. 7, a relatively upper portion in the housing 3 in the third embodiment, wherein a first plate 27 which is modified from the stamping 26 of FIG. 6 to have slots 27*c* and the substantially rectangular tabs 27*b* projecting in the same direction as the flanges 27*a* project, is used and into a center slot of which the tube member 24 is press-fitted. A second plate 28 of FIG. 8 including a body surface portion 28*a* and slots 28*c* is additionally used for alternately opening and closing air passages between the first and second through-holes 4 and 5 through spaced portions 28*b*. The second plate 28 is secured to the bottom side of the governer plate 6 by means of the pins 9 press-fitted into the slots 28*c*. Operation of the third embodiment will not be described as it is the same as those cases described above. In this third embodiment, the first plate 27 is secured by press-fitting to the tube member 24 at position above the governer advance adjusting mechanism so that the first plate 27 is not under the advance effects of such advance adjusting mechanism, thus causing a precision position control of flanges 27*a* to position of the first through-hole 4 in relation to the exact discharge timing. Consequently, length of the longitudinal direction of the flanges 27*a* can be reduced. Reducing length of the flanges 27*a* will in turn cause enlarged spaces between the flanges 27*a*, thereby to effect a good circulation of air in the housing 3.

In the first to third embodiments so far described above, the flanges or tongues 6*a*, 25*b* and 26*a*, and space portions therebetween are respectively formed by dividing its circumference equally into equal parts, however, it, of course, may be possible to decide the length of those flanges in the rotational direction for good air circulation thereof in consideration of the governer advance angle, the negative pressure advance angle and the like. In addition, the members 6, 25, 26, 27 and 28 are all disc type, but they may be modified into columnar members respectively. Further, it may also be possible to provide such through-holes in the distributor cap 18. The embodiments have been referred to an ignition distributor in the case of four-cylinder, four-cycle automotive engine, however, same effects may be achieved if the present invention is applied to other type of engines.

In the afore-going embodiments thus far constructed, it will be apparent that the member secured to the distributor shaft can substantially opens and closes the through-holes communicating between the inside of and the outside of the distributor housing in relation to the exact discharge timing, whereby the ignition distributor of the present invention has a great advantage such that an unfavorable thing accidentally happened within the distributor housing, which triggered by the discharge action, can be prevented from reaching through such through-holes to the outside of the distributor housing and that a sufficient amount of air flow therethrough can be effected in the event the discharge does not occur.

What is claimed is:

1. An ignition distributor for an internal combustion engine, comprising:

a distributor housing including a body and a cap;

a drive shaft rotatably supported by said housing to be driven by the internal combustion engine;

a rotor electrode secured to a rotor drivingly connected with said drive shaft;

a plurality of spaced counter-electrodes carried by said cap;

a wall of said distributor housing being provided with first and second spaced ventilating ducts;

a first closure member secured to said drive shaft and being cup-like shaped having a plurality of axial flanges spaced on its circumference, and a body portion; and a second closure member secured to said drive shaft and being a disc type having recessed portions, and a body portion, wherein when a discharge occurs in said housing between said rotor electrode and one of said counter-electrodes, said first ventilating duct is substantially closed by one of said flanges of said first closure member while said body portion of said second closure member intervenes between said second ventilating duct and one of said counter-electrodes, and when a discharge does not occur, said first ventilating duct is opened by the space between said flanges while said second ventilating duct is opened by said recessed portions.

2. An ignition distributor for an internal combustion engine, comprising:

a distributor housing including a body and a cap;

a drive shaft rotatably supported by said housing to be driven by the internal combustion engine;

a rotor electrode secured to a rotor drivingly connected with said drive shaft;

a plurality of spaced counter-electrodes carried by said cap; and means for controlling ventilation communication between the inside and the outside of said distributor housing in accordance with the timing of the discharges between said rotor electrode and said counter-electrodes.

3. An ignition distributor according to claim 2, wherein the communication controlling means includes at least one ventilating duct extending through a wall of said housing and at least one closure member for an inner end of said duct connected to the drive shaft.

4. An ignition distributor according to claim 3, wherein the communication controlling means includes first and second ventilating ducts and one closure member, said closure member being cup-like shaped having a plurality of axial flanges spaced on its circumference and a body portion, so that one of said flanges substantially closes the inner end of said first ventilating duct when a discharge occurs, and said body portion intervenes between the inner end of said second ventilating duct and one of said counter-electrodes irrespective of the occurrence of a discharge.

5. An ignition distributor according to claim 4, wherein said closure member further has recessed portions in said body portion, said recessed portions being positioned adjacent the inner end of said second ventilating duct when a discharge does not occur, so that said second ventilating duct is also opened as well as said first ventilating duct when a discharge does not occur.

6. An ignition distributor according to claim 4, wherein said closure member further includes substantially rectangular tabs stamped from said body portion and projecting outwardly therefrom, and slots formed thereby, said slots being positioned adjacent the inner end of said second ventilating duct when a discharge does not occur, so that said second ventilating duct is also opened as well as said first ventilating duct when a discharge does not occur.

* * * * *